US007748367B2

(12) United States Patent
Kosjer

(10) Patent No.: US 7,748,367 B2
(45) Date of Patent: Jul. 6, 2010

(54) FUNGO BATTING ASSISTANCE MACHINE

(76) Inventor: Marcus Kosjer, 6103-12th Rd., Douglass, KS (US) 67039

( * ) Notice: Subject to any disclaimer, the term of this patent is extended or adjusted under 35 U.S.C. 154(b) by 751 days.

(21) Appl. No.: 11/397,129

(22) Filed: Apr. 4, 2006

(65) Prior Publication Data

US 2007/0232419 A1 Oct. 4, 2007

(51) Int. Cl.
*F41B 3/03* (2006.01)

(52) U.S. Cl. ..... 124/16; 124/36

(58) Field of Classification Search ..... 124/16, 124/17, 36, 79

See application file for complete search history.

(56) References Cited

U.S. PATENT DOCUMENTS

| | | | | | |
|---|---|---|---|---|---|
| 3,394,691 | A * | 7/1968 | Brink | 124/7 |
| 3,722,494 | A * | 3/1973 | Slevin | 124/7 |
| 3,841,294 | A * | 10/1974 | McGill | 124/16 |
| 4,254,755 | A * | 3/1981 | Morgan et al. | 124/16 |
| 4,282,848 | A * | 8/1981 | Kulesza et al. | 124/16 |
| 4,402,507 | A * | 9/1983 | Hudson | 124/7 |
| 4,669,444 | A * | 6/1987 | Whitfield et al. | 124/16 |
| 4,714,069 | A * | 12/1987 | Ulrich | 124/26 |
| 4,778,177 | A * | 10/1988 | Taksony | 473/451 |
| 4,865,318 | A * | 9/1989 | Lehmann et al. | 124/16 |
| 4,907,802 | A * | 3/1990 | Gatin | 124/7 |
| 5,415,150 | A * | 5/1995 | Dallas | 124/50 |
| 5,485,994 | A * | 1/1996 | Underwood et al. | 473/451 |
| 5,590,876 | A * | 1/1997 | Sejnowski | 473/417 |
| 5,660,386 | A * | 8/1997 | Krieger | 124/7 |
| 5,759,083 | A * | 6/1998 | Polumbaum et al. | 446/435 |
| 5,800,288 | A * | 9/1998 | Mims | 473/417 |
| 5,911,214 | A * | 6/1999 | Andrews | 124/16 |
| 5,975,527 | A * | 11/1999 | Winchester | 273/129 V |
| 6,546,923 | B2 * | 4/2003 | Erickson | 124/16 |
| 7,213,724 | B1 * | 5/2007 | Langer et al. | 221/289 |
| 2002/0151388 | A1 * | 10/2002 | Buster et al. | 473/451 |
| 2004/0266562 | A1 * | 12/2004 | Gowan et al. | 473/416 |

OTHER PUBLICATIONS

Abstract of Japan patent application 2000176071, published Jun. 27, 2002.*

* cited by examiner

*Primary Examiner*—John Ricci
(74) *Attorney, Agent, or Firm*—Kenneth H. Jack; Davis & Jack, L.L.C.

(57) ABSTRACT

A fungo batting assisting machine having a frame; a cradle mounted upon the frame, the cradle having a ball percussion port; a hammer; a first pivot joint interconnecting the hammer and the frame so that the hammer may move between a spring energy position underlying the ball percussion port and a ball driving position overlying the spring energy position; a ball driving spring normally positioning the hammer between its spring energy and ball driving positions; a trip arm extending from the hammer; a pawl arm; a second pivot joint interconnecting the pawl arm and the frame so that the a pawl arm may move between a trip arm carrying position and a trip arm releasing position; and an actuation lever extending from the pawl arm.

15 Claims, 6 Drawing Sheets

FUNGO BATTING ASSISTANCE MACHINE

FIELD OF THE INVENTION

This invention relates to apparatus and machinery which is adapted for assisting in baseball or softball fielding practice. More particularly, this invention relates to such apparatus or machinery which is specially adapted for performing ball tosses for fungo batting.

BACKGROUND OF THE INVENTION

Ball tossing fungo batting assistance machines are known. However, such machines typically are bulky, cumbersome, and mechanically complex. Also, such machines typically undesirably require the provision of an outside power source such as alternating current electricity. Also, such machines typically lack any capacity for adjustments of ball toss height and trajectory, and such machines often lack a sufficiently large ball magazine or ball feeder.

The instant inventive fungo batting assistance machine overcomes the drawbacks and deficiencies discussed above by providing a mechanically simple machine which is capable of repeatedly tossing a series of baseballs or softballs at adjustable heights and trajectories for fungo batting.

BRIEF SUMMARY OF THE INVENTION

A first structural component of the instant inventive fungo batting assistance machine comprises a support frame. Preferably, the support frame comprises one inch by one inch (1"×1") steel square tubing, and includes a front base member and a rear base member. Preferably, the frame further comprises lateral or left and right "A" members, the lower ends of the legs of which are preferably fixedly welded to the front and rear base members. The mechanically defined space between the left and right "A" frame members advantageously provides a ball cradle and ball strike mechanism mounting space.

A further preferred structural component of the instant inventive fungo batting assistance machine preferably comprises a ball cradle fixedly mounted upon the frame. Preferably, the ball cradle is mounted between the frame's left and right "A" members. Also preferably, the ball cradle forms and mechanically defines within its floor a ball percussion port. In a preferred embodiment of the instant invention, the ball cradle is configured as a forwardly elongated and upwardly opening "C" channel, such channel having a sufficient lateral width to receive a series of baseballs or softballs. The preferred forward elongation of such ball cradling "C" channel advantageously accommodates receipt and dispensation of a series of balls. The preferred forwardly elongated "C" channel cradle may advantageously comprise left and right "L" beams whose lower flanges are spaced laterally apart to form and mechanically define the cradle's ball percussion port.

Also, in a preferred embodiment, the forwardly elongated "C" channel cradle comprises hingedly interconnected forward and rearward sections, such configuration facilitating rearward pivoting and folding of the cradle's forward section for purposes of compact storage and transport of the machine.

A further structural component of the instant inventive fungo batting assistance machine comprises a ball striking hammer. Preferably, the ball striking hammer comprises a length of steel square tubing having a ball strike plate fixedly welded to such tube's forward end. The length of such square tubing extending rearwardly from such ball strike plate advantageously functions as a pivot arm for pivotally moving the ball strike plate in a common hammer swinging and hammer striking motion.

A further preferred structural component of the instant inventive fungo batting assistance machine comprises first pivotal mounting means. Preferably, the first pivotal mounting means pivotally interconnects the hammer and the frame. Also preferably, the first pivotal mounting means positions the hammer so that the hammer's preferred ball strike plate may move reciprocatingly between a downwardly displaced "spring energy" position and an upwardly displaced ball driving position. Preferably, the downwardly displaced spring energy position directly underlies the ball cradle's ball percussion port, while the upwardly displaced ball driving position directly overlies the ball percussion port. Suitably, the first pivotal mounting means may comprise a pivot axle or pivot pin extending laterally through the rearward end of the hammer's preferred pivot arm, and whose left and right ends are fixedly attached to the frame. Other commonly known means for pivotally interconnecting structures for relative pivotal motion, such as hinges and elastically deformable members are considered to fall within the scope of the invention's incorporation of first pivotal mounting means.

A further preferred structural component of the instant inventive fungo batting assistance machine comprises ball driving spring means connected operatively to the hammer. Preferably, the ball driving spring means is adapted and positioned for normally positioning the hammer's preferred ball strike plate between such plate's downwardly displaced spring energy position and such plate's upwardly displaced ball driving position. Upon deflection of the hammer and its ball strike plate downwardly to the spring energy position, potential mechanical energy is advantageously temporarily stored within the spring means. Upon sudden release of such stored potential energy, the spring means imparts upwardly directed kinetic energy to the hammer and its ball strike plate, moving the ball strike plate rapidly upward toward its upwardly displaced ball driving position. Assuming that a baseball or softball is cradled by the ball cradle in an overlying position, the ball strike plate meets such ball, imparting an upward percussive force to the ball within and through the cradle's ball percussion port. Such percussive force advantageously propels the baseball or softball upwardly into the air for fungo batting.

A preferred ball driving spring means comprises a helical rarefaction spring having a rearward end fixedly attached to the hammer's forward end, and having a forward end fixedly anchored at a forwardly displaced anchor point. Where the ball cradle comprises the preferred left and right "L" beams, such anchor point may advantageously comprise a crossbar fixedly attached to and spanning between undersurfaces of such "L" beams. Suitably, the spring means may alternately comprise an elastomeric strap or band. Also suitably, the spring means may alternately comprise helical springs mounted axially over the hammer's preferred pivot pin pivotal mounting means.

Where the spring means comprises the preferred helical rarefaction spring, spring tension adjustment means are preferably further provided for facilitating adjustability of the mechanism's ball striking force. A preferred spring tension adjusting means will be described in greater detail in the Detailed Description which follows.

A further preferred structural component of the instant inventive fungo batting assistance machine comprises a trip arm. Preferably, the trip arm is fixedly attached to or wholly formed with the hammer and extends, preferably rearwardly, from the rearward end of the hammer. Also preferably, the trip arm extends rearwardly from the hammer's pivot axis. Preferably, the extreme rearward or distal end of the trip arm is chamfered or beveled, presenting an angled upwardly and rearwardly oriented slide face. In operation, pivoting movement of the trip arm advantageously exerts a levering action or torque upon the hammer, utilizing the pivot axis the hammer's first pivotal mounting means as a fulcrum.

A further preferred structural element of the instant inventive fungo batting assistance machine comprises a pawl arm and second pivotal mounting means interconnecting the pawl arm and the frame. The second pivotal mounting means preferably further positions the pawl arm so that a distal end of such arm may pivotally move between a trip arm carrying position and a trip arm releasing position. Means such as those described above as being suitable substitutes for the first pivotal mounting means are also deemed suitable for alternate service as the second pivotal mounting means.

While the pawl arm is pivotally moved to its trip arm carrying position, the distal end of the pawl arm preferably underlies an undersurface of the rearward end of the trip arm. Upon upward pivotal movement of the pawl arm toward its trip arm releasing position, the distal end of the pawl arm may advantageously clear the extreme rearward or distal end of the trip arm, releasing the trip arm.

In a preferred embodiment, the pawl arm is segmented, comprising forward and rearward segments, and the forward segment preferably being attached pivotally to the rearward segment. Such pivotal interconnection of pawl arm segments advantageously allows the pawl arm's forward segment to move between a trip arm engaging position and a trip arm passage position, as will be further explained in the Detailed Description which follows.

A further structural component of the instant inventive fungo batting assistance machine comprises an actuation lever fixedly attached or formed wholly with the pawl arm. The actuation lever preferably extends rearwardly and upwardly from the pawl arm and extends from the point of the pawl arm's second pivotal mounting means.

In operation of the instant inventive fungo batting assistance machine, at least a first baseball or softball, and preferably a plurality of such balls, are placed in a forwardly extending series within the machine's ball cradle. Upon such ball placement, a rearmost ball preferably rearwardly rolls to a position overlying the ball cradle's ball percussion port. Thereafter, an operator, using his or her left or right foot, may press downwardly upon the actuation lever. Such downward driving motion upwardly pivotally moves the machine's pawl arm. Such upward pivotal motion of the pawl arm progressively upwardly pivots the machine's trip arm and simultaneously downwardly pivots the machine's hammer against the ball driving spring means. Accordingly, the kinetic energy of the operator's downwardly driven foot is temporarily stored as potential energy within the spring means. Upon progression of such pivotal motion, the extreme distal or forward end of the pawl arm eventually slidably clears the extreme distal or rearward end of the trip arm, allowing for the rapid release of such potential spring energy. Upon such release, the preferred ball driving spring drives the hammer upwardly through the ball percussion port and against the ball, driving the ball into the air for fungo batting.

Preferably, a second spring is provided for normally pivotally returning the actuating lever and pawl arm to the pawl arm's trip arm carrying position. Upon such pivotal return of the actuation lever, a second successive downward depression of the lever may drive a second baseball or softball into the air for a second fungo batting swing. Such succession of steps may be continuously repeated so long as baseballs or softballs are present within the ball cradle.

Accordingly, objects of the instant invention include the provision of a fungo batting assistance machine incorporating structural elements as described above wherein such elements are arranged for the performance of functions as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
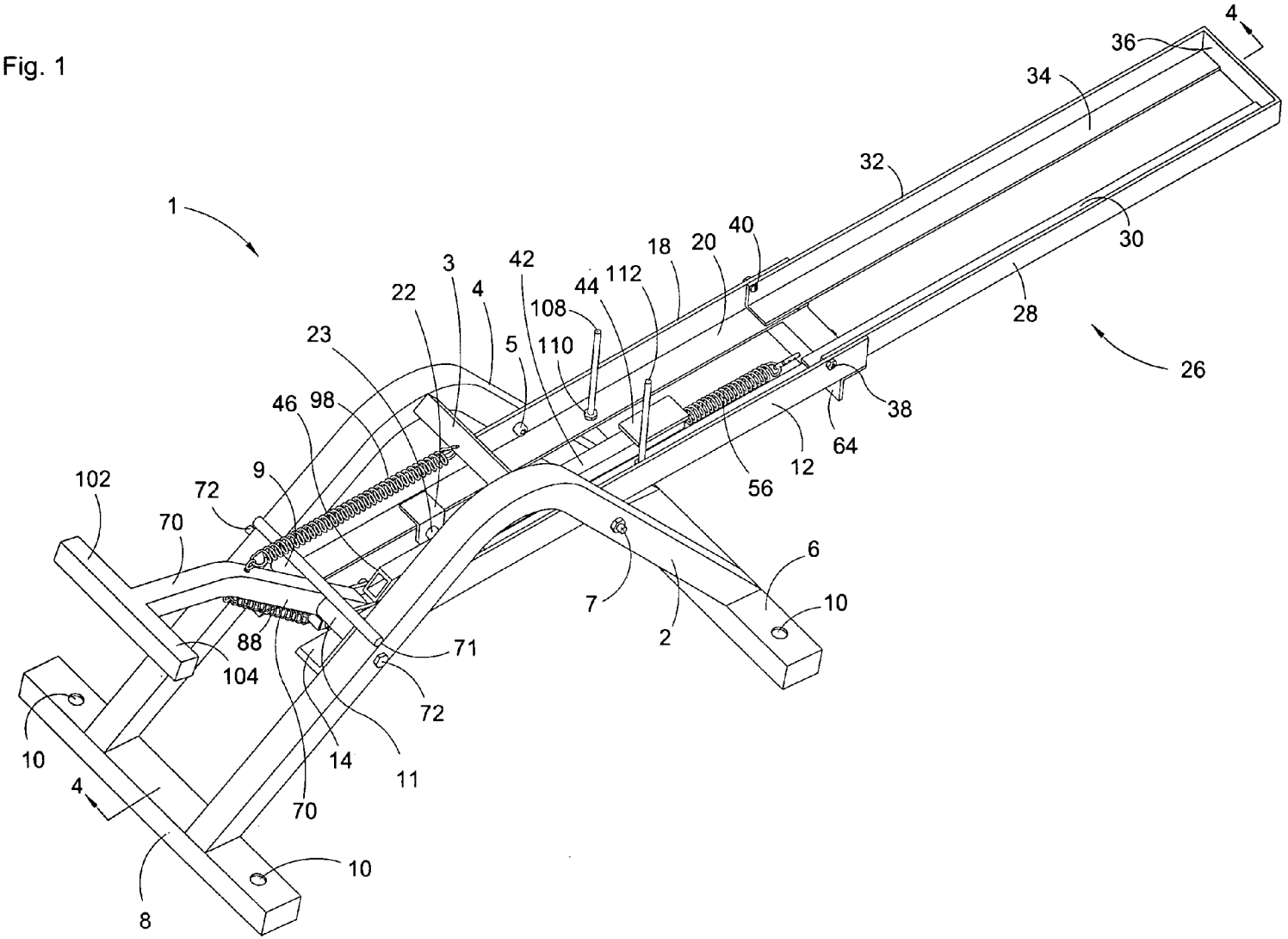
FIG. 1 is an isometric view of a preferred embodiment of the instant inventive fungo batting assistance machine.

Referring now to the drawings, and in particular to FIG. 1, a preferred embodiment of the instant inventive fungo batting assistance machine is referred to generally by Reference Arrow 1. The machine 1 preferably comprises a frame which includes a front base member 6 and a rear base member 8. The frame 1 preferably further comprises a right "A" member 2 and a left "A" member 4, the lower ends of the legs of such "A" members 2 and 4 being fixedly welded to the base members 6 and 8. Further preferred frame components comprise a spring anchoring cross member 3 and a pivot stopping crossing member 71. The frame also preferably further comprises right and left longitudinally extending "L" beam members 12 and 18, such "L" beams being fixedly attached to "A" members 2 and 4 by nut and bolt combinations 5 and 7, and by a laterally extending pivot pin 72. Preferably, the outer ends of the base members 6 and 8 of the frame include vertically extending ground stake receiving apertures 10.

Referring further to FIG. 1, the machine 1 preferably comprises a ball cradle mounted between the "A" members 2 and 4. The ball cradle may be advantageously provided by configuring the "L" beams 12 and 18 to include forwardly extending ends, as depicted. In such forwardly extended "L" beam configurations, the lower flanges 14 and 20 of the "L" beams 12 and 18 advantageously serve as a ball supporting floor while the vertical flanges of the "L" beams 12 and 18 serve as ball retaining walls. The medial space between the inner edges of the floor flanges 14 and 20 advantageously forms and defines a ball percussion port where ball striking may occur.

Figure 3:
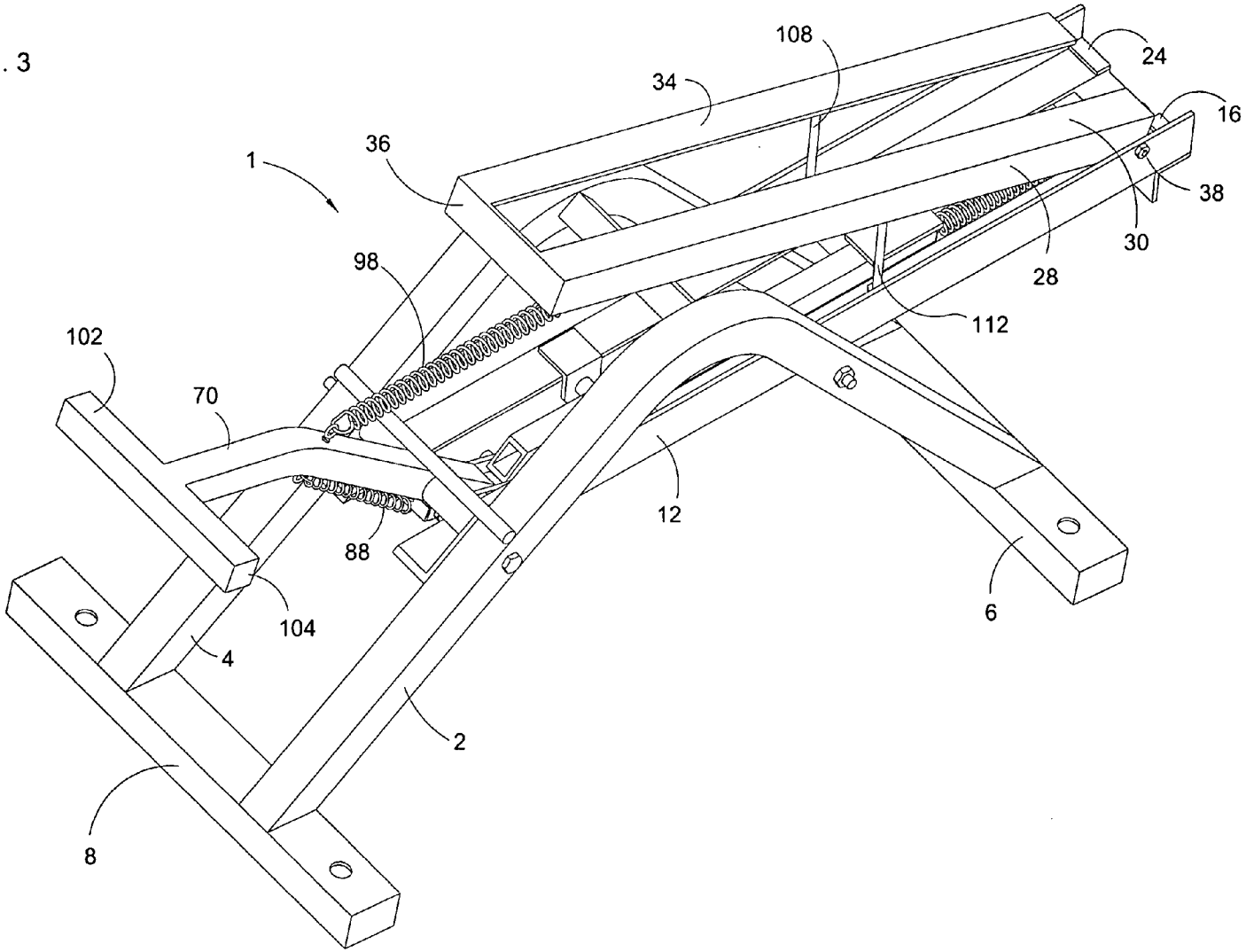
FIG. 3 redepicts FIG. 1, the view of FIG. 3 showing the machine of FIG. 1 in a compact storage configuration.
Figure 4:
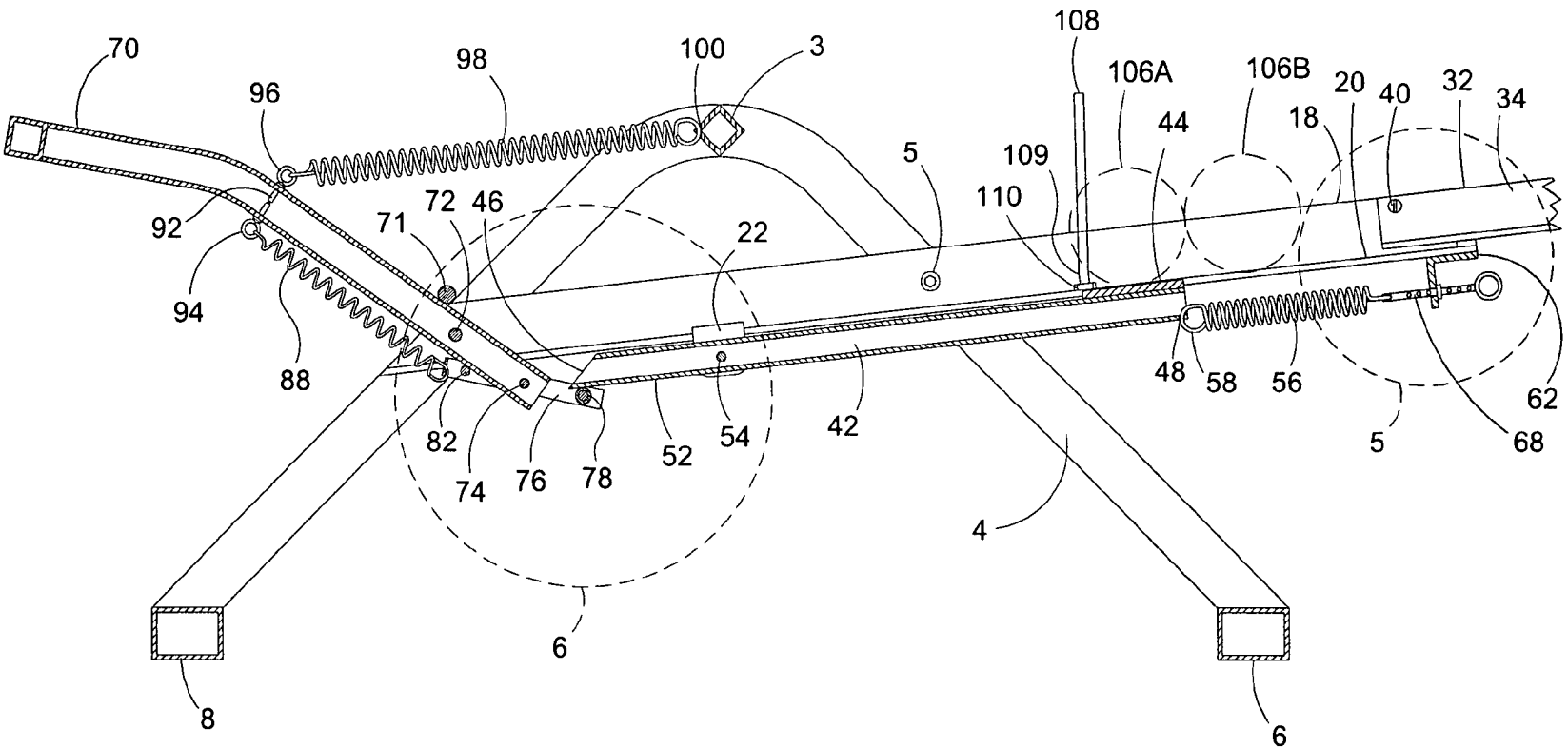
FIG. 4 is a sectional view as indicated in FIG. 1.

Referring further to FIG. 1, the ball cradle preferably further includes a pivoting forward section 26 which is configured similarly with the rearward section of the ball cradle, the forward section including right and left "L" beams having right and left floor flanges 30 and 34, and having right and left ball retaining walls 28 and 32. Preferably, the rearward end of the forward section of the cradle 26 is pivotally mounted to the forward end of the rearward section of the cradle by nut and bolt combinations 38 and 40. The forward end of the rearward section of the cradle preferably includes a spring anchoring "L" beam cross member 64, and the forward end of the forward section of the cradle preferably includes a structural reinforcing cross member 36. Referring simultaneously to FIGS. 1, 3, and 4, right and left pivot stopping lugs 16 and 24 are preferably fixedly welded to the extreme forward ends of the floors 14 and 20 of "L" beams 12 and 18, such pivot stopping lugs advantageously stopping hyper-extension of the foldable forward section 26 of the ball cradle.

Figure 2:
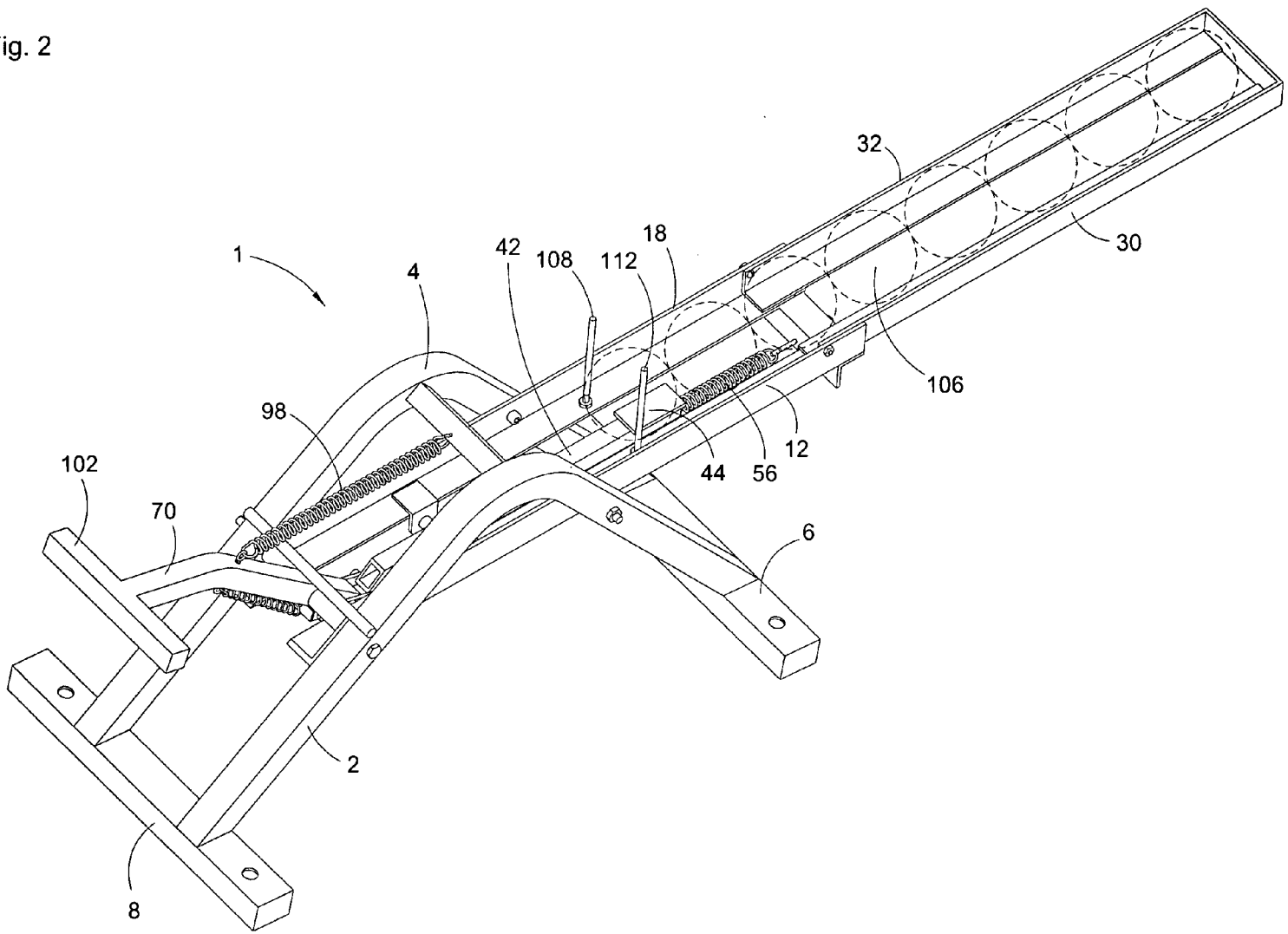
FIG. 2 redepicts FIG. 1, the view of FIG. 2 showing a series of baseballs or softballs loaded within the machine.

Referring simultaneously to FIGS. 1 and 2, a plurality of baseballs or softballs 106 may be loaded into the upwardly opening "C" channel space of the cradle. Preferably, rearward downslope rolling motions of the balls 106 within the ball cradle is stopped by trajectory guiding pins 108 and 112, such pins 108 and 112 being attached to the cradle's floor flanges 14 and 20 by helically threaded nuts 110. Referring further simultaneously to FIG. 4, it can be seen that the trajectory guiding pins 108 and 112 are canted or bent at their bases slightly forwardly, and away from the perpendicular. Preferably, the trajectory guiding pins 108 and 112 are composed of easily bendable mild steel. Such pins' capability of being bendingly adjusted forwardly or rearwardly advantageously serves as a ball trajectory adjustment means. Other suitable ball trajectory adjustment means such as releasable and lockable pivot joints may suitably be substituted as the ball trajectory adjustment means.

Referring simultaneously to FIGS. 1 and 4, a hammer 42 having a ball strike plate 42 fixedly welded to its forward end is preferably provided. Preferably, the rearward end of the hammer 42 is pivotally mounted to the frame by means of left and right pivot pin supporting brackets 22 mounted upon floor flanges 14 and 20. Such pivot pin supporting brackets 22 support a laterally extending pivot pin 54 and support left and right spacer sleeves 23 for centering the hammer 42 beneath the ball percussion port.

Figure 6:
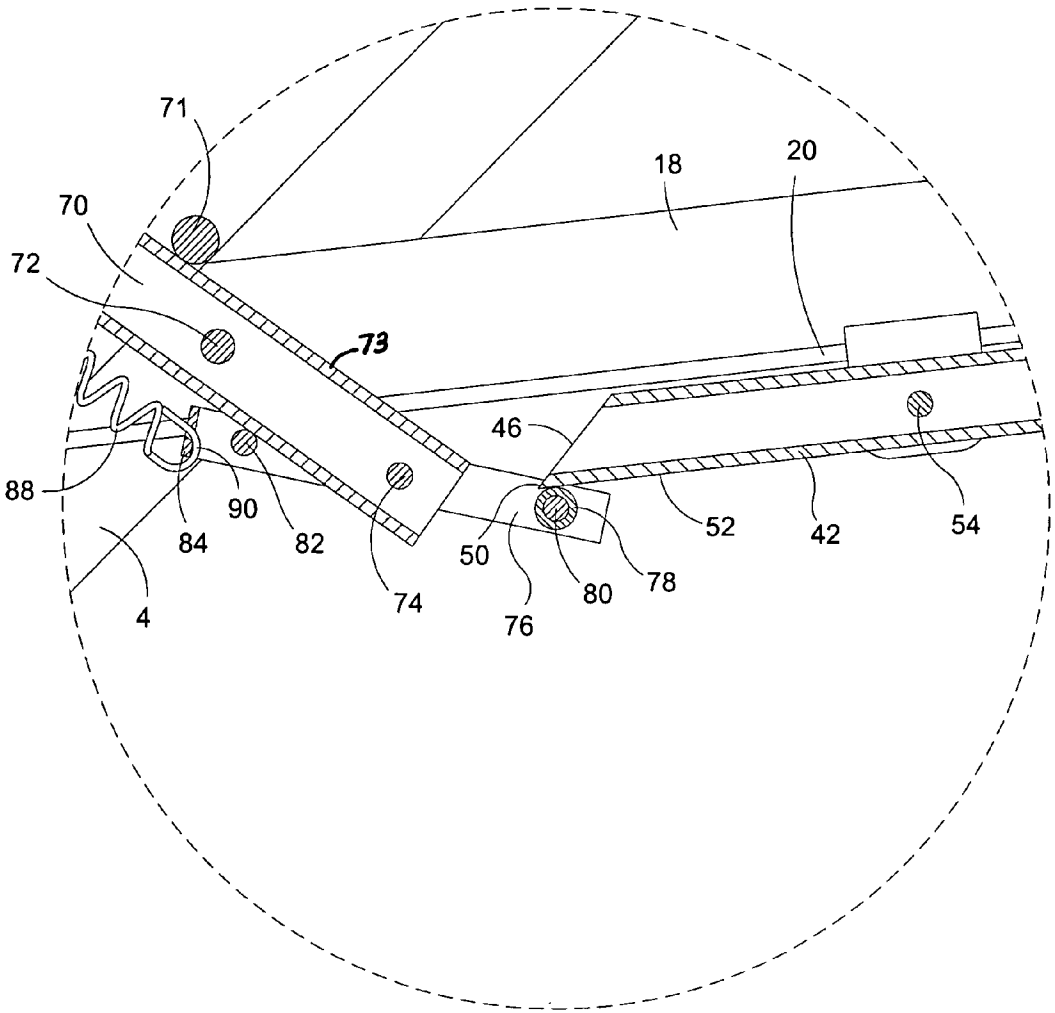
FIG. 6 is an alternate partial magnified view as indicated in FIG. 4.

Referring further simultaneously to FIGS. 1, 4, and 6 a trip arm 52 is preferably fixedly attached to or formed wholly with the hammer 42, the trip arm 52 preferably extending rearwardly from the rearward end of the hammer 42. The extreme rearward end of the trip arm 52 preferably is configured to include a beveled or chamfered face 46. In operation, the trip arm 52 functions as a lever for, upon upward pivotal motion of the trip arm, pivotally and downwardly displacing the hammer 42 to a "spring energy" position.

Figure 5:
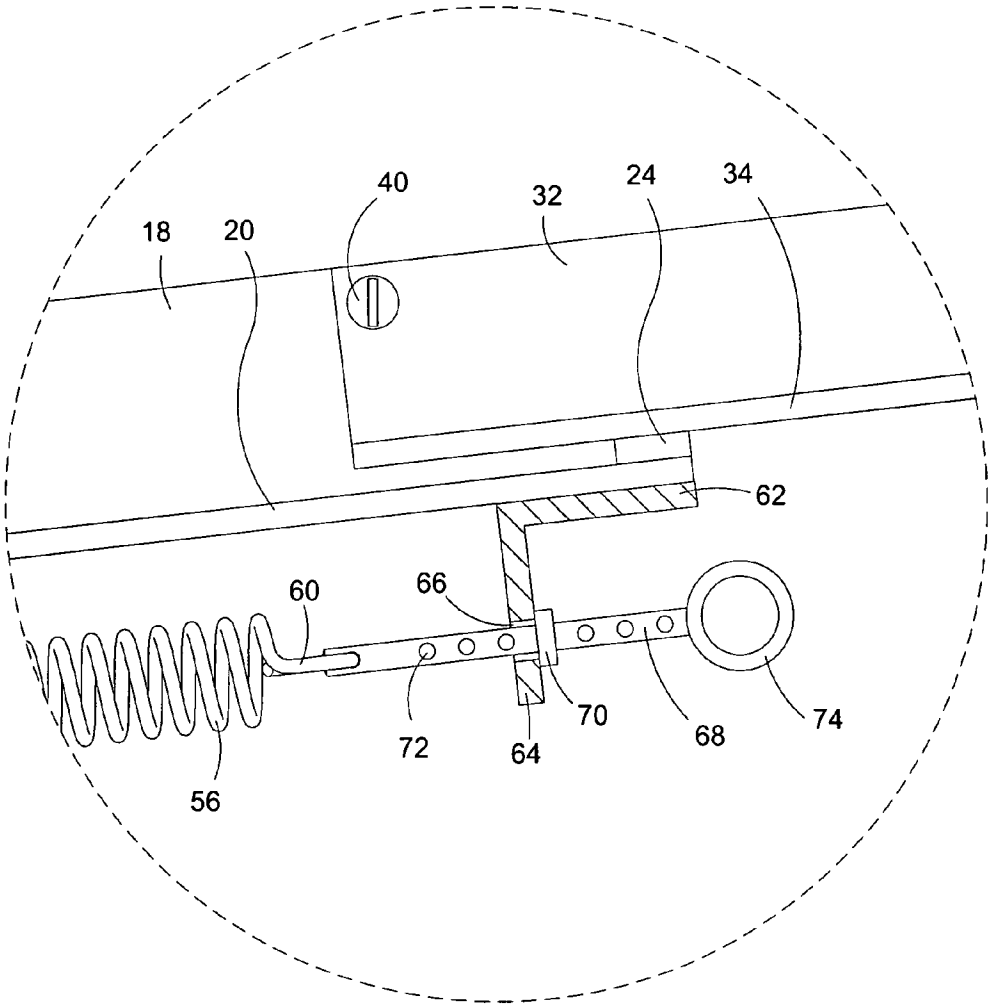
FIG. 5 is a partial magnified view as indicated in FIG. 4.

Referring simultaneously to FIGS. 1, 4, and 5, a steel helical spring 56 having a rear attachment hook 58 and having a front attachment hook 60 preferably spans between "L" beam cross member 62 and the forward end of the hammer 42. The rear attachment hook 58 of the spring 56 preferably extends through and engages an attachment aperture 48 within the extreme forward end of the hammer 42. In order to adjustably interconnect the forward attachment hook 60 of the spring 56 and the "L" beam 62, an adjustment pin 68 having a pull ring 74 and a series of sheer pin receiving apertures 72 is preferably provided. The adjustment pin 68 extends through an aperture 66 within the downwardly extending flange 64 of the "L" beam cross member 62. A removable slide stopping sheer pin 70 may be selectively placed within one of the apertures 72 for adjusting the rearward extension of the adjustment pin 68, thereby adjusting the tension of the spring 56.

Referring simultaneously to FIGS. 1, 2, 4, and 6, a pawl arm is preferably provided, the pawl arm preferably consisting of a forwardly extending length of steel square tubing 73 and a forwardly extending pivoting bracket 76. Such length of steel square tubing 73 comprises a rear segment of the preferred pawl arm, while the forwardly extending bracket 76 comprises a forward section of the pawl arm. Such rearward and forward pawl arm sections are preferably pivotally interconnected by a pivot pin 74 which laterally extends through the forward end of the rearward section 73 and through the rearward end of the forward bracket section 76. A contact roller 78 supported by a laterally extending pin 80 is preferably fixedly mounted at the forward end of the pawl arm's forward bracket section 76. Preferably, left and right plate members of the bracket 76 extend rearwardly from pivot pin 74 to form a lever arm 84, such plates being laterally interconnected by a pivot stopping pin 82.

Referring simultaneously to FIGS. 1, 4, and 6, the forwardly and rearwardly sectioned pawl arm is preferably pivotally mounted to the frame by the laterally extending pivot pin 72, such pivot pin additionally mounting and supporting the rearward ends of right and left "L" beams 12 and 18. The pivot pin 72 also extends through left and right spacer sleeves 9 and 11, which advantageously center the pawl arm between "L" beams 12 and 18.

Referring in particular to FIG. 6, upon counter-clockwise pivoting motion of the pawl arm about pivot pin 72, the contact roller 78 upwardly biases against the undersurface of the trip arm 52. While such upward biasing occurs, the forward segment 76 of the pawl arm remains in its trip arm carrying position. Such pivotal motion and upward biasing pressure may continue until the contact roller 78 rollably moves to the extreme rearward or distal end 50 of the trip arm 52, at which point the roller 78 may pass upwardly beyond such extreme distal end 50, releasing its engagement with the trip arm 52. Thereafter, upon return clockwise pivoting motion of the pawl arm about pivot pin 72, the contact roller 78 may come into contact with the chamfered or beveled face 46 of the trip arm 52, pivoting the forward bracket section 76 of the pawl arm counter-clockwise about pivot pin 74 to a trip arm passage position. Pivotal movement of the pawl arm's forward section to the trip arm passage position advantageously allows the contact roller 78 to rollably pass downwardly beyond distal end point 50 to reoccupy the trip arm engaging and carrying position depicted in FIG. 6.

Referring simultaneously to FIGS. 1, 4, and 6, an actuating lever arm 70 is preferably provided, such lever arm 70 preferably being fixedly attached to or formed wholly with the rear section 73 of the pawl arm. The actuating lever 70 preferably carries a spring attachment pin 92, such pin having lower and upper spring attachment eyes 94 and 96. A helical spring 88 preferably spans between eye 94 and an aperture within the rearward extension 84 of the forward bracket section 96 of the pawl arm. The attachment hook 90 of the spring 88 extending through an aperture within such rearward extension interconnects the spring 88 and the bracket extension 84. Similarly, an overlying helical spring 98 interconnects eye 96 and cross member 3, the forward attachment hook of spring 98 extending through an attachment aperture 100 within cross member 3.

In operation of the instant inventive fungo batting assistance machine, referring in particular to FIG. 3, the machine 1 may be initially configured in the compact folded storage configuration as depicted. Thereafter, an operator may carry the machine 1 to a desired location within a baseball or softball practice field, placing the machine 1 upon the ground. Thereafter, the operator may grasp cross member 36 and, referring further simultaneously to FIG. 1, the operator may pivotally move the forward section 26 of the cradle about bolts 38 and 40 to the position depicted in FIG. 1. Thereafter, the operator may drive ground stakes (not depicted) through apertures 10 within the base members 6 and 8 for further stabilizing the machine. Thereafter, referring further simultaneously to FIG. 2, the operator may place a plurality of baseballs 106 within the upwardly opening "C" channel of the cradle. Upon placement of the balls 106 within the cradle, such balls roll down slope and rearwardly, and are stopped by the trajectory guiding pins 108 and 112. Referring further simultaneously to FIG. 4, it can be seen that the rearmost ball 106A directly overlies the strike plate 44 of the hammer 42.

Thereafter, referring simultaneously to FIGS. 2, 4, 5, and 6, the operator, while wielding a fungo bat (not depicted), may drive downwardly with his or her left or right foot against foot pedal 102 which is attached to the extreme rearward end of actuation lever 70. Such downward driving foot action pivots the lever 70 counter-clockwise about pivot pin 72, causing the forwardly extending pawl arm segments 73 and 76 to simultaneously pivot counter-clockwise. Such counter-clockwise pivoting motion of the pawl arm drives the contact roller 78 upwardly against the lower surface of the trip arm 52, pivoting the trip arm 52 clockwise about pivot pin 54. Such clockwise pivoting motion of the trip arm 52 simultaneously pivots the hammer 42 clockwise and downwardly toward a downwardly displaced spring energy position. Such downward displacement stretches the spring 56 and effectively transfers the downward foot driving force to potential spring energy temporarily stored within the spring 56. The counter-clockwise pivoting motion of the pawl arm may continue until the contact roller 78 reaches the extreme distal or pointed end 50 of the trip arm 52. At such point, the pawl arm releases the trip arm, allowing the spring 56 to forcefully counter-pivot the hammer 42 about pivot pin 54, allowing the ball strike plate 44 to move upwardly through the ball percussion port to an upwardly displaced ball driving position wherein the ball 106A is driven upwardly into the air for fungo batting.

In the event that the ball 106A is driven to an excessive height, sheer pin 70 may be withdrawn from the adjustment pin 68, and such sheer pin 70 may be forwardly re-inserted into another adjustment aperture 72, lessening the normal tension of the spring 56 and lessening the height to which balls 106 are driven. Conversely, if additional height is needed, the sheer pin 70 may alternately be rearwardly re-inserted into a more rearward adjustment aperture 72.

In order to adjust the trajectory of the ball, the trajectory guiding pins 108 and 112 may be manually and adjustably bent forwardly or rearwardly, allowing such pins to guide the balls 106 in a desirable selected upward path.

Referring simultaneously to FIGS. 2, 4, 5, and 6, upon upward driving and fungo batting of ball 106A, ball 106B successively rolls rearwardly to assume a like position overlying the ball strike plate 44. Thereafter, the operator may release his or her foot pressure upon pedal 102, allowing spring 98 to counter-pivot lever 70 clockwise about pivot pin 72 to the pivot stop 71. Upon such counter-pivoting motion, the pawl arm simultaneously counter-pivots in the clockwise direction about pivot pin 72 until the contact roller 78 contacts the chamfered face 46 of the rear or distal end of the trip arm 52. Upon such contact, the forward bracket segment 76 of the pawl arm pivots counter-clockwise about pivot pin 74, advantageously preventing the contact roller 78 from undesirably counter-pivoting the trip arm 52 and the hammer 42, and preventing the next successive ball 106B from being undesirably jostled upwardly out of the cradle. As the forward bracket section 76 of the pawl arm pivots counter-clockwise, and as the rearward section 73 of the pawl arm simultaneously pivots clockwise, the contact roller 78 rollably moves downwardly and rearwardly along chamfered face 46 until the roller reaches the extreme distal end 50 of the trip arm 52. At such point, the contact roller 78 may pass downwardly beyond such point 50, and at such point spring 88 pivotally moves the forward bracket section 76 back to the trip arm engaging and carrying position depicted in FIG. 6. Such returning pivoting motion is advantageously stopped by pin 82 against the rearward section 73 of the pawl arm. Upon return of the pawl arm to the position depicted in FIG. 6, the mechanism is reconfigured for a successive application of foot pressure to pedal 102, successively driving ball 106B into the air. Accordingly, the mechanism automatically and repeatedly resets itself for a next successive ball driving stroke.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A fungo batting assistance machine comprising:

(a) a frame;

(b) a cradle mounted upon the frame, the cradle having a ball percussion port;

(c) a hammer;

(d) first pivotal mounting means interconnecting the hammer and the frame so that the hammer may move between a spring energy position underlying the ball percussion port and a ball driving position overlying the spring energy position;

(e) ball driving spring means normally positioning the hammer above its spring energy position and below its ball driving position;

(f) a trip arm extending from the hammer;

(g) a pawl arm;

(h) second pivotal mounting means interconnecting the pawl arm and the frame so that the pawl arm may move between a trip arm carrying position and a trip arm releasing position; and (l) a lever extending from the pawl arm, the cradle comprising an upwardly opening "C" channel.

2. The fungo batting assistance machine of claim 1 wherein the upwardly opening "C" channel is forwardly elongated.

3. The fungo batting assistance machine of claim 2 wherein the upwardly opening "C" channel comprises forward and rearward sections, and further comprises hinged mounting means interconnecting the forward and rearward sections.

4. The fungo batting assistance machine of claim 1 wherein the hammer comprises a pivot arm having a forward end, and wherein the hammer further comprises a strike plate, the strike plate being fixedly attached to the pivot arm's forward end.

5. The fungo batting assistance machine of claim 4 wherein the ball driving spring means comprises a helical spring having forward and rearward ends, the rearward end of the helical spring being fixedly attached to a forward end of the hammer.

6. The fungo batting assistance machine of claim 5 further comprising spring tension adjustment means fixedly attached to the forward end of the helical spring.

7. A fungo batting assistance machine comprising:

(a) a frame;

(b) a cradle mounted upon the frame, the cradle having a ball percussion port;

(c) a hammer;

(d) first pivotal mounting means interconnecting the hammer and the frame so that the hammer may move between a spring energy position underlying the ball percussion port and a ball driving position overlying the spring energy position;

(e) ball driving spring means normally positioning the hammer above its spring energy position and below its ball driving position;

(f) a trip arm extending from the hammer;

(g) a pawl arm;

(h) second pivotal mounting means interconnecting the pawl arm and the frame so that the pawl arm may move between a trip arm carrying position and a trip arm releasing position;

(l) a lever extending from the pawl arm; and (m) a pair of trajectory guiding pins fixedly attached to and extending upwardly from the cradle.

8. The fungo batting assistance machine of claim 7 further comprising trajectory adjusting means, the trajectory adjusting means being fixedly attached to or formed wholly with the trajectory guiding pins.

9. A fungo batting assistance machine comprising:

(a) a frame;

(b) a cradle mounted upon the frame, the cradle having a ball percussion port;

(c) a hammer;

(d) first pivotal mounting means interconnecting the hammer and the frame so that the hammer may move between a spring energy position underlying the ball percussion port and a ball driving position overlying the spring energy position;

(e) ball driving spring means normally positioning the hammer above its spring energy position and below its ball driving position;

(f) a trip arm extending from the hammer;

(g) a pawl arm;

(h) second pivotal mounting means interconnecting the pawl arm and the frame so that the pawl arm may move between a trip arm carrying position and a trip arm releasing position; and (l) a lever extending from the pawl arm, the trip arm having a rearward end, the rearward end of the trip arm being chamfered.

10. The fungo batting assistance machine of claim 9 wherein the pawl arm comprises a forward segment and a rearward segment, and further comprising third pivotal mounting means interconnecting the forward and rearward segments so that the forward segment may pivotally move between a trip arm engaging position and a trip arm passage position.

11. The fungo batting assistance machine of claim 10 wherein the pawl arm's forward segment has a forward end, and further comprising a contact roller fixedly attached to said forward end.

12. The fungo batting assistance machine of claim 11 further comprising spring biasing means connected operatively to the pawl arm, the spring biasing means being adapted for normally moving the pawl arm's forward section to its trip arm engaging position.

13. A fungo batting assistance machine comprising:

(a) a frame;

(b) a cradle mounted upon the frame, the cradle having a ball percussion port;

(c) a hammer;

(d) first pivotal mounting means interconnecting the hammer and the frame so that the hammer may move between a spring energy position underlying the ball percussion port and a ball driving position overlying the spring energy position;

(e) ball driving spring means normally positioning the hammer above its spring energy position and below its ball driving position;

(f) a trip arm extending from the hammer;

(g) a pawl arm;

(h) second pivotal mounting means interconnecting the pawl arm and the frame so that the pawl arm may move between a trip arm carrying position and a trip arm releasing position;

(l) a lever extending from the pawl arm, the lever having a rearward end, and further comprising a pedal fixedly attached to the lever's rearward end; and (m) spring biasing means connected operatively to the lever, the spring biasing means being adapted for normally moving the lever and the pawl arm's trip arm carrying position.

14. The fungo batting assistance machine of claim 13 wherein the spring biasing means comprises a helical spring having a rearward end and a forward end, the rearward end of helical spring being fixedly attached to the lever, the forward end of the helical spring being fixedly attached to the frame.

15. The fungo batting assistance machine of claim 14 further comprising a pivot stop fixedly attached to the frame, the pivot stop being adapted for stopping pivotal motion of the lever arm and the pawl arm at the pawl arm's trip arm carrying position.

* * * * *